US006267846B1

(12) United States Patent
Halmschlager et al.

(10) Patent No.: US 6,267,846 B1
(45) Date of Patent: Jul. 31, 2001

(54) TWIN WIRE FORMER AND METHOD OF MANUFACTURING A FIBROUS MATERIAL WEB FROM A FIBROUS SUSPENSION USING SAME

(75) Inventors: Günter Halmschlager, Krems (AT); Volker Schmidt-Rohr, Heidenheim (DE); Helmut Tausel, Middletown, OH (US); Franz Stelzhammer, Böheimkirchen (AT); Erich Brunnauer; Alexander Wassermann, both of Vienna (AT); Günther Prinz, Obergrafendorf (AT); James Ronning, Middletown, OH (US)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/237,842

(22) Filed: Jan. 27, 1999

(30) Foreign Application Priority Data

Jan. 30, 1998 (DE) ..... 198 03 591

(51) Int. Cl.[7] ..... D21F 1/00
(52) U.S. Cl. ..... 162/203; 162/300; 162/301
(58) Field of Search ..... 162/300, 301, 162/203, 352, 303

(56) References Cited

U.S. PATENT DOCUMENTS

| | | | | |
|---|---|---|---|---|
| 2,881,676 | * | 4/1959 | Thomas | 162/301 |
| 3,619,362 | * | 11/1971 | Parker | 162/301 |
| 3,726,758 | | 4/1973 | Parker et al. | 162/301 |
| 3,839,143 | | 10/1974 | Suckow . | |
| 3,876,499 | * | 4/1975 | Vesanto | 162/303 |
| 4,925,531 | | 5/1990 | Koski | 162/301 |

(List continued on next page.)

FOREIGN PATENT DOCUMENTS

| | | |
|---|---|---|
| 1903382 | 9/1969 | (DE) . |
| 2051444 | 8/1971 | (DE) . |
| 7702891 | 7/1980 | (DE) . |

(List continued on next page.)

OTHER PUBLICATIONS

Entwicklung und Betriebserfahrungen mit Bel–Baie–Former, published in the trade journal "Das Paper," 1970, No. 10A, pp. 779–784.
Beloit introduces the horizontal Bel Baie former, published in "Pulp & Paper" May 1986.

*Primary Examiner*—Karen M. Hastings
(74) *Attorney, Agent, or Firm*—Greenblum & Bernstein, P.L.C.

(57) ABSTRACT

Twin wire former and method for manufacturing a fibrous material web from a fibrous suspension using same. The twin wire former comprises a movable bottom wire belt and a movable top wire belt converging at a twin wire zone. The twin wire zone has a first section, a second section and an end section. A rotating forming roller is disposed at the first section of the twin wire zone, and the to wire and the bottom wire form a wedge-shaped inlet gap at the first section of the twin wire zone. The inlet gap is adapted to receive the fibrous suspension from a headbox. The bottom wire belt and the top wire belt are adapted to form the fibrous web therebetween at the second section of the twin wire zone, and the second section of the twin wire zone has at least one drainage element. A separating device is disposed at the end of the twin wire zone and is adapted to separate one wire belt from another the wire belt. The twin wire zone has a section disposed in a steep downward direction downstream of the forming roller in relation to the movement of the wires. Also disclosed is a method for manufacturing a fibrous material web from a fibrous suspension using a twin wire former.

55 Claims, 6 Drawing Sheets

U.S. PATENT DOCUMENTS

| | | | | |
|---|---|---|---|---|
| 5,074,964 | * | 12/1991 | Partanen | 162/301 |
| 5,074,966 | * | 12/1991 | Koivuranta | 162/301 |
| 5,259,929 | | 11/1993 | Bubik et al. | 162/301 |
| 5,389,206 | * | 2/1995 | Buck et al. | 162/301 |
| 5,480,520 | * | 1/1996 | Esslinger | 162/301 |
| 5,647,958 | | 7/1997 | Schmidt-Rohr et al. . | |
| 5,788,816 | * | 8/1998 | Steckenreuter et al. | 162/301 |

FOREIGN PATENT DOCUMENTS

| | | |
|---|---|---|
| 8205443 | 7/1982 | (DE) . |
| 3222428 | 12/1983 | (DE) . |
| 4102065 | 7/1992 | (DE) . |
| 4328997 | 12/1993 | (DE) . |
| 4301103 | 8/1994 | (DE) . |
| 4420801 | 12/1995 | (DE) . |
| 19530983 | 2/1997 | (DE) . |
| 197 20 258 | 5/1997 | (DE) . |
| 197 33 316 | 8/1997 | (DE) . |
| 198 03 451 | 1/1998 | (DE) . |
| 0489094 | 6/1992 | (EP) . |
| 0894894 | 2/1999 | (EP) . |
| 2187990 | 1/1974 | (FR) . |
| 1327444 | 8/1973 | (GB) . |

* cited by examiner

TWIN WIRE FORMER AND METHOD OF MANUFACTURING A FIBROUS MATERIAL WEB FROM A FIBROUS SUSPENSION USING SAME

CROSS-REFERENCE TO RELATED APPLICATIONS

The present application claims priority under 35 U.S.C. § 119 of German Patent Application No. 198 03 591.8, filed on Jan. 30, 1998, the disclosure of which is expressly incorporated by reference herein in its entirety.

BACKGROUND OF THE INVENTION

1. Field of the Invention

The invention relates to a twin wire former and method of manufacturing a fibrous material web with a twin wire former, and more particularly, to a twin wire former and method for manufacturing a fibrous material web, such as a paper web, from a fibrous suspension.

2. Discussion of Background Information

Twin wire formers are known in related art apparatus. One such apparatus is disclosed in European Patent No. EP 0489094. This document disclosed a twin wire former with two wire belts, which jointly constitute a twin wire zone. At the beginning of the twin wire zone, the two wire belts jointly form a wedge-shaped inlet gap, which receives the fibrous suspension directly from a headbox. The two wire belt are thus known as a "gap former." Directly at the wedge-shaped inlet gap, the two wires travel by way of a rotatable forming roller. Downstream from the forming roller with respect to the rotational direction thereof, the two wire belts contact forming strips and/or forming shoes inside the twin wire zone.

In other embodiments of twin wire formers, the two wires travel in a generally horizontal direction or ascend diagonally inside the twin wire zone. Consequently, the drainage devices disposed inside the perimeter of the upper wire require relatively high suction to remove the water. In other embodiments, the two wire belts travel in a generally vertical direction upward from the bottom, at the inlet gap. The belts travel by way of a forming roller, which is embodied as a suction roller. In drainage boxes disposed above the forming roller, a few deflection surfaces are necessary to remove the water, possibly requiring a suction connection.

Twin wire formers according to above-noted European Patent No. EP 0489094 may be useful, especially when a forming roller is disposed directly at the inlet gap. Because of the presence of this forming roller, the two wires are guided along a sharply curved path about the circumference of the forming roller immediately downstream of the inlet gap. This sharply curved path is required because the sleeve of the forming roller has a small radius in comparison with the large radius of a forming shoe disposed at the inlet gap. When the suspension stream coming out of the headbox enters the wedge-shaped inlet gap, a large portion of the suspension flows almost in a straight line through the top wire. From the top wire, the water stream breaks up rapidly and uniformly over the width of the machine. Rapid and uniform breakup of the water stream contributes to rapid and uniform web formation. High quality finished fibrous material webs may be produced by this twin wire former, even though the web is rapidly formed.

The disposition of the forming roll at the beginning of the twin wire zone enables both the top wire and bottom wire to be stretched tautly, which creates longitudinal tension, thereby preventing the forming of wire tubes in the travel direction. Additionally, keeping the top wire taut in the lateral direction contributes to uniform web formation, particularly in the critical beginning region of the web formation. Keeping the top wire taut in the lateral direction additionally helps prevent the defect known as "longitudinal striping" in the paper.

However, a disadvantage of the twin wire former known from the above reference EP 0489094 is that during operation, a large amount of energy is used for the production of suction. Furthermore, the starting up of this twin wire former is sometimes difficult when there is a backup of water in the machine.

The trade journal "Das Paper" [Paper] 1970, No. 10A, pp. 779 to 784, disclosed a twin wire former with a twin wire zone that steeply travels in a downward direction. The convexly curved forming shoe that both wires wind around is provided before a forming roller around which both wires wind.

SUMMARY OF THE INVENTION

The present invention provides a twin wire former and method for manufacturing a fibrous material web from a fibrous suspension using a twin wire former. The device of the present invention comprises a movable bottom wire belt and a movable top wire belt converging at a twin wire zone. The twin wire zone has a first section, a second section and an end section. A rotating forming roller is disposed at the first section of the twin wire zone, the top wire and the bottom wire forming a wedge-shaped inlet gap at the first section of the twin wire zone, the inlet gap being adapted to receive the fibrous suspension from a headbox. The bottom wire belt and the top wire belt form the fibrous web therebetween at the second section of the twin wire zone, and the second section of the twin wire zone has at least one drainage element. The invention also comprises a separating device adapted to separate one wire belt from the other wire belt. The twin wire zone has a section disposed in a steep downward direction downstream of the forming roller in relation to the movement of the wire belts.

The steep downward direction of the twin wire zone may be an angle between about 10 and 50 degrees from the vertical, and is preferably between about 10 and 45 degrees from the vertical.

The twin wire former may also include a deflection device for deflecting the bottom wire belt and the top wire belt from the steep downward direction section, to a generally horizontal direction.

In another aspect of the invention, the invention may also comprise a breast roller disposed upstream from the forming roller in relation to the movement of the top wire, the breast roller being adapted to guide the top wire. The breast roller and the headbox together may then be pivoted about a rotational axis of the forming roller.

Furthermore, the invention may comprise a convexly curved forming shoe disposed against the top wire at the steep downward direction section of the twin wire zone. At least one deflector disposed against the bottom wire may be provided opposite the forming shoe. The invention may further comprise at least one forming strip flexibly disposed against the bottom wire, opposite the forming shoe.

A further aspect of the invention may provide at least one forming strip flexibly disposed against the top wire at the circumference of the forming roller.

According to another aspect of the invention a first and a second balanced-pressure drainage element (which may be fluid permeable and/or perforate) at the steep downward direction section of the twin wire zone may be provided, the first balanced-pressure drainage element being stationary and disposed against the top wire belt. The second balanced-pressure drainage element is flexibly disposed opposite the first balanced-pressure drainage element against the second wire belt. These elements may be embodies as plates or plate segments.

A convexly curved guide plate, which may be perforated, may also be disposed alongside and downstream from the forming roller in relation to the movement of the wire belts, the top wire belt and the second wire belt being adapted to travel over the convexly curved guide plate, the convexly curved guide plate further resting against the top wire.

Additionally, inside the twin wire zone, the top wire belt and the bottom wire belt may be configured so that they only come into contact with the forming roller, the forming shoe and the suction device. The separating device may be a stationary separating suction device disposed against the bottom wire at the steep downward direction section of the twin wire zone.

Furthermore, at least one additionally suction device may be provided at the steep downward direction section of the bottom wire, and a removal device adapted to remove the fibrous web material from the bottom wire at a point downstream from the at least one additional suction device may also be provided.

The top wire belt and the bottom wire belt may also be adapted to be conveyed by a wire suction roller at a point downstream from the steep downward direction section. The wire suction roller may be disposed against an inside perimeter of the top wire. The wire suction roller may also have a separating suction zone adapted for separating the fibrous material web and the top wire from the bottom wire.

The method of manufacturing a fibrous material web from a fibrous suspension using a twin wire former comprises the steps of depositing the fibrous suspension from a headbox into the inlet gap, draining fluid from the fibrous suspension through the rotating forming roller, forming a fibrous web between the first and second wire belts, draining fluid through the fibrous web through a drainage element, and separating one wire belt and the formed fibrous web material from the other wire belt.

The method may also comprise deflecting the two wire belts from the steep downward direction to a generally horizontal direction with a deflection device.

Additionally, the method may comprise guiding the top wire about a breast roller disposed upstream from the forming roller in relation to the movement of the top wire, and adjusting the size of a winding angle of the top wire by pivoting the breast roller with the headbox, about a rotational axis of the forming roller.

Furthermore, the method may comprise using a convexly curved forming shoe to form the fibrous web between the first and second wire belts.

The method may additionally comprise forming the fibrous web between the first and second wire belts with a forming strip.

The method may yet still comprise forming the fibrous web between the first and second wire belts with a balanced-pressure drainage element at the steep downward direction section.

Other exemplary embodiments and advantages of the present invention may be ascertained by reviewing the present disclosure and the accompanying drawings.

BRIEF DESCRIPTION OF THE DRAWINGS

The present invention is further described in the detailed description which follows, in reference to the noted plurality of drawings by way of non-limiting examples of certain embodiments of the present invention, in which like numerals represent like elements throughout the several views of the drawings, and wherein.

DETAILED DESCRIPTION OF THE PRESENT INVENTION

Figure 1:
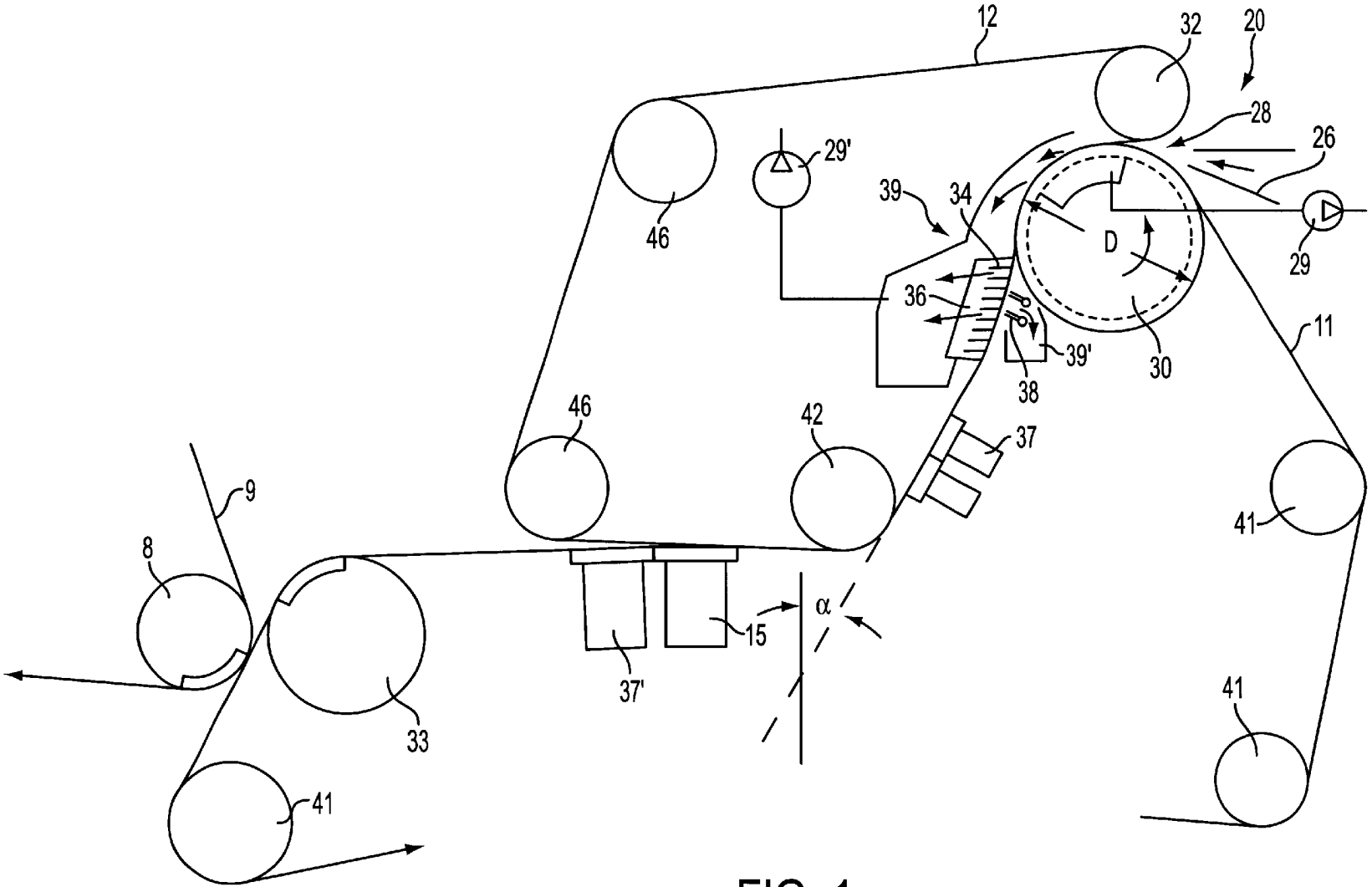
FIG. 1 schematically shows a side schematic view of a twin wire former according to a first embodiment of the present invention.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

The present invention allows drainage elements of a twin wire zone to be operated at lower energy cost and with less suction than related art inventions.

The twin wire zone travels steeply downward from a forming roller that is disposed directly at a wedge-shaped inlet gap. As a result, the removal of most of the suspension water passing through the twin wire zone takes place largely due to gravitational force. The sleeve of the forming roller has recesses for the temporary storage of water. The stored water is removed in the downward direction from the sleeve of the forming roller. Consequently, sometimes (e.g., with a relatively low operating speed) the forming roller need not be a suction roller. When using a suction roller, the suction roller may be operated with less suction than with art related twin wire formers.

The removal of most of the suspension water passing through the twin wire zone by gravitational force, allows less suctional force to be used in drainage elements downstream from the forming roller, than with art related twin wire formers. Alternatively, suction may not be necessary at all. Additionally, the removal of most of the suspension water passing through the twin wire zone by gravitational force, facilitates the starting up of the twin wire former and reduces the danger of the backing-up of water.

A headbox is disposed at an elevated position in relation to the twin wire zone, to reduce the danger of backflows, which is particularly important for operation at low speeds. The headbox may be equipped with a turbulence generator and/or flow elements. Exemplary flow elements are separation elements and formation elements. Such a headbox is described in commonly-assigned U.S. patent application Ser. No. 08/861,383, filed on May 21, 1997, which is expressly incorporated herein in its entirety.

Furthermore, the headbox is positioned so that control elements are easily accessible by a user, e.g., the valves for the addition of dilution water may be more easily accessed. Similarly, the forming roller is disposed so that it can be simply installed or removed with a crane.

Large quantities of water are removed at the two wire belts in the region of the forming roller. Web formation occurs at the beginning of the twin wire zone in a rapid and uniform manner. Increasing the quantities of water removed at the region of the forming roller is further possible, thereby reducing quantities of water removed at the region of the subsequent stationary drainage elements (e.g., strips). By increasing the quantities of water removed at the region of the forming roller and by reducing use of suction, stronger webs may be produced.

Referring now to the drawings wherein like numerals represent like elements, the twin wire former represented in FIG. 1 includes two endless wire belts, namely a bottom wire 11 and a top wire 12. The wires 11, 12 are complete belts, although they are shown broken in the Figs. for illustrative purposes. At a forming roller 30, these wires, 11, 12 form a twin wire zone. The top wire 12 travels by way of a breast roller 32 upstream of contacting the bottom wire 11 at the circumference of the forming roller 30. The two wire belts 11 and 12 jointly form a wedge-shaped inlet gap 28 between the forming roller 30 and the breast roller 32, the inlet gap being present at a first section of the twin wire zone. The inlet gap receives a fibrous suspension from a headbox 26, the headbox 26 being schematically indicated. The headbox is equipped with a device that provides for the sectional and controllable addition of dilution water for the purpose of adjusting the desired cross section of the finished paper web, the device being well known to those skilled in the art.

The twin wire former 20 has a water collecting device 39 inside the perimeter of the top wire 12 at the region of the forming roller 30. A large part of the suspension water which passes through the top wire 12 at the beginning of the twin wire zone is transported to the water collecting device 39, which occurs at the upper left quadrant of the forming roller 30, in FIG. 1. At the general level of the rotational axis of the forming roller 30, the two wires 11, 12, together with the fibrous material web being formed therebetween, travel downward and away from the forming roller. Downstream of the forming roller 30 (at a second section), the wires 11, 12 travel along a convexly curved forming shoe 36, which is disposed against the top wire 12 on the inside perimeter of the top wire 12, the shoe having a plurality of drainage strips 34. Additional suspension water passes into the catch basin 39 between these drainage strips 34. Still more suspension water flows through the bottom wire 11 into a catch basin 39'. Bottom forming strips 38 may be provided here. The bottom forming strips 38 may be flexibly pressed against the bottom wire 11 in a manner known by those skilled in the art. Alternatively, as shown according to a second embodiment in FIG. 2, instead of bottom forming strips 38, at least one deflector 40 can be used with the bottom wire 11 in the region of the forming shoe 36.

The sleeve of the forming roller 30 has recesses for temporary storage of water, for example, a honeycomb cover (not shown) or a wire sock (not shown). While a suction device 29 is shown only in FIGS. 1 and 6, the forming roller 30 may also be a suction roller in all embodiments of the invention. Additionally, the water collecting device 39 disposed inside the loop of the top wire 12 and the forming shoe 36 may be connected to a suction source 29' in all embodiments of the invention.

In preferred embodiments of the present invention, the two wires 11, 12 travel steeply downward in the twin wire zone downstream from the forming roller 30. In this region, the twin wire zone, together with an imaginary vertical plane, forms an angle a, which is between about 10 and 50 degrees. In this region, the top wire 12 is always disposed above the bottom wire 11. Angle a is preferably less than about 45 degrees. In the portion of the twin wire zone that travels steeply downwardly, drainage elements may be provided, such as suction devices 37 that touch the bottom wire 11. Example of drainage elements are forming shoes 36, suction devices 37 and balanced-pressure drainage elements 16, 17.

According to the embodiments of FIGS. 1, 2, 3 and 6, a deflection device, e.g., a deflection roller 42 is provided at the end of the suction of the twin wire zone that travels steeply downwardly. The deflection roller 42 deflects both wire belts 11, 12 into a generally horizontal direction of travel. Inside the loop of the bottom wire 11, a separating suction device 15 is provided (at the end section of the twin wire zone), which lifts the top wire 12 up from the bottom wire and also from the paper web disposed thereon. Other examples of separating devices are stationary separating suction devices 25 and wire suction rollers 35. The top wire 12 travels from the separating suction device 15 via guide rollers 46, and returns back to the breast roller 32. After the separating suction device 15, the bottom wire 11 travels by way of at least one additional suction device 37' to a wire suction roller 33 and then via guide rollers 41 back to the forming roller 30. However, in alternative embodiments, the additional suction device 37' need not be used. The formed paper web is removed from the bottom wire 11 immediately downstream from the wire suction roller 33 by a removal device such as a felt band 9 and a removal roller 8, although it will be readily appreciable by those skilled in the art that other removal devices may be employed in other embodiments.

In the embodiments according to FIGS. 1, 4, 5 and 6, the outflow direction of the headbox 26 is almost horizontal or ascends slightly (as shown). In these embodiments, the headbox need not run idle when there is a temporary stoppage of the paper making machine. Thus, there is no deformity due to cooling during the stoppage. According to the disposition of the headbox 26 in accordance with the embodiments of FIGS. 1, 4, 5 and 6, the top wire 12 winds about the upper descending quadrant of the forming roller 30.

Figure 2:
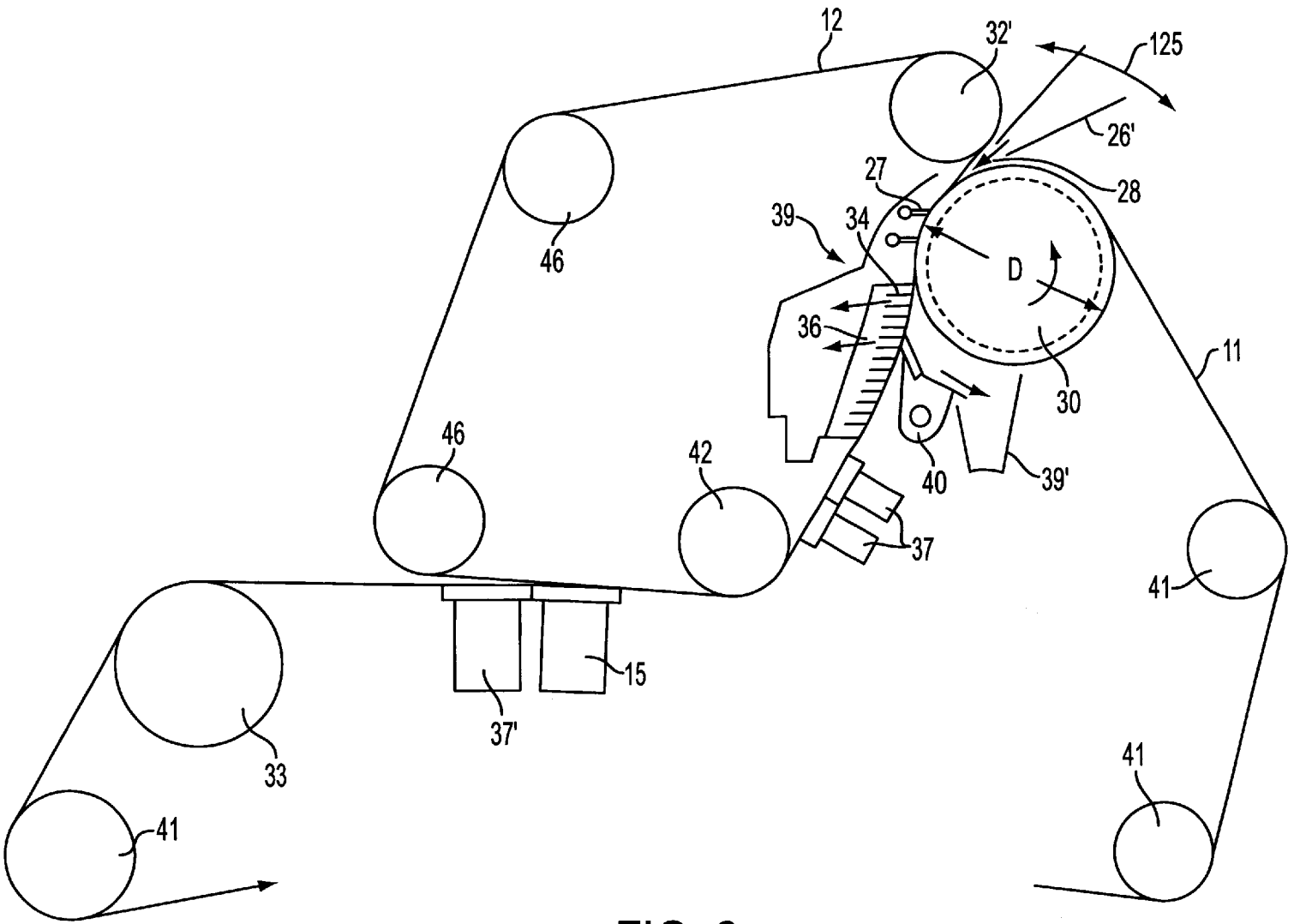
FIG. 2 schematically shows a side schematic view of a twin wire former according to a second embodiment of the present invention.
Figure 3:
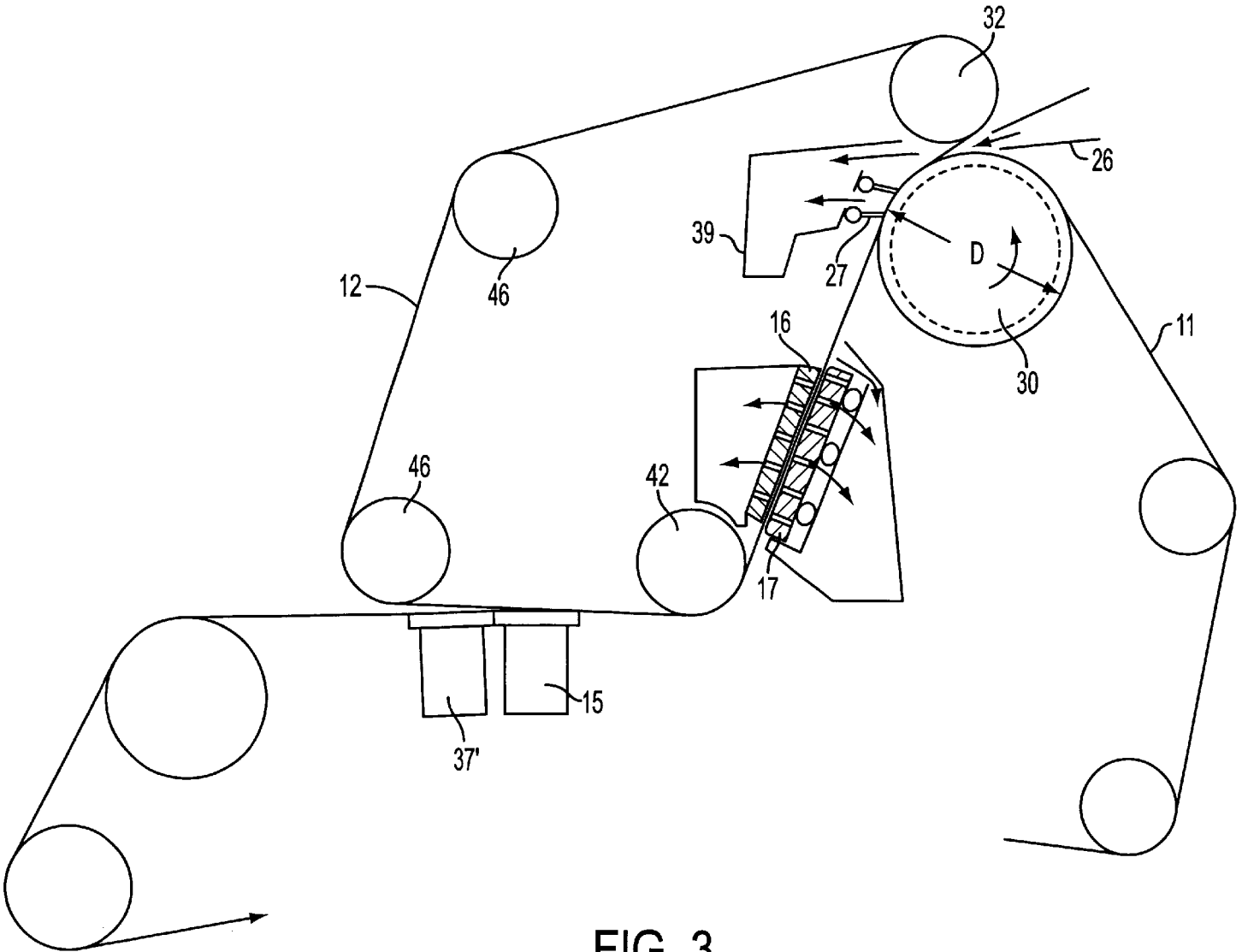
FIG. 3 schematically shows a side schematic view of a twin wire former according to a third embodiment of the present invention.

According to the embodiments shown in FIGS. 2 and 3, a smaller winding zone of the top wire 12 on the forming roller 30 is provided. The outflow direction of headbox 26' is directed horizontally downwardly from the right of FIGS. 2 and 3. To change the position of the inlet gap 28, the headbox 26' and breast roller 32' can be pivoted about the rotational axis of the forming roller 30, as indicated by double arrow 125 in FIG. 2, and as shown in German Patent No. DE 4328997.

As shown in FIGS. 2 and 3, at least one flexible top forming strip 27 which can be flexibly pressed against the top wire 12, can be provided on the circumference of the forming roller 30, as shown in German Patent No. DE 4301103.

According to the embodiment of FIG. 3, first and second balanced-pressure drainage elements 16, 17 respectively, are provided at the section of the twin wire zone that travels steeply downwardly. The balanced-pressure drainage elements 16, 17 are preferably perforated plates or plate segments. The first balanced-pressure drainage element 16 is stantionarily fixed on the inside of the perimeter of the top wire 12 and is part of a stationary drainage box and, for example, rests against the top wire 12. The stationary drainage box may be provided with suction, if necessary.

With the aid of pneumatic hoses, the second balanced-pressure drainage element 17 flexibly rests on another stationary box, opposite the first balanced-pressure drainage element 16, and can be flexibly placed against the bottom wire 11 by ways known to those skilled in the art. The balanced-pressure drainage elements of the present invention assist in removing suspension fluid by subjecting the fibrous material web to a draining pressure which is substantially free of pulsations. Balanced-pressure drainage elements 16, 17 of this kind are disclosed in German Patent Application No. DE 19733316. Balanced-pressure drainage elements 16, 17 of this kind can also be disposed in the generally horizontal part of the twin wire zone. According to FIG. 6, a convexly curved guide plate 14 is placed against the inside of the perimeter of the top wire 12 between the forming roller 30 and the balanced-pressure drainage elements 16, 17, in order to prevent the wires 11, 12 from temporarily separating from each other. In the preferred embodiment, the guide plate 14 is perforated, but it will be readily appreciable by those skilled in the art that non-perforated guide plates may be used in other embodiments.

Figure 4:
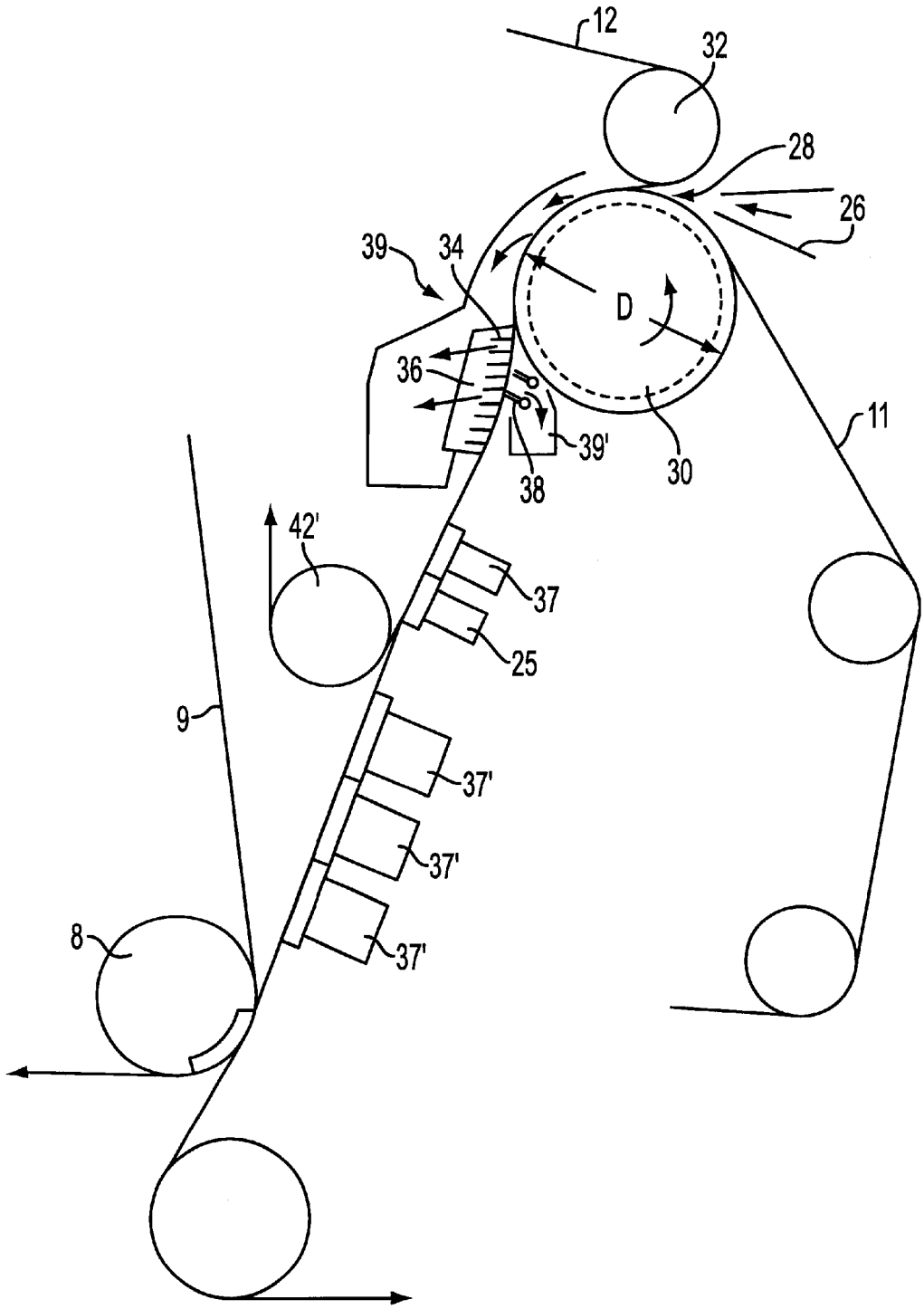
FIG. 4 schematically shows a side schematic view of a twin wire former according to a fourth embodiment of the present invention.

According to the embodiment of FIG. 4, the two wires 11, 12 only come into contact with stationary drainage elements and the forming roller 30, when the two wires are inside the twin wire zone. Specifically, the two wires 11, 12 only contact the forming shoe 36, and if necessary, contact the bottom forming strips 38 and a suction device 37. The suction device 37 is followed by a stationary separating suction device 25. Downstream of the separating suction device 25, the top wire 12 is conveyed back upwardly by way of guide roller 42'. Downstream of the separating suction device 25, the bottom wire 11 travels steeply downwardly, by way of additional suction devices 37', whereupon the paper web is removed from the bottom wire 11 by known devices of a felt band 9 and a removal roller 8. In alternative embodiments, additional suction devices 37' need not be used.

Figure 5:
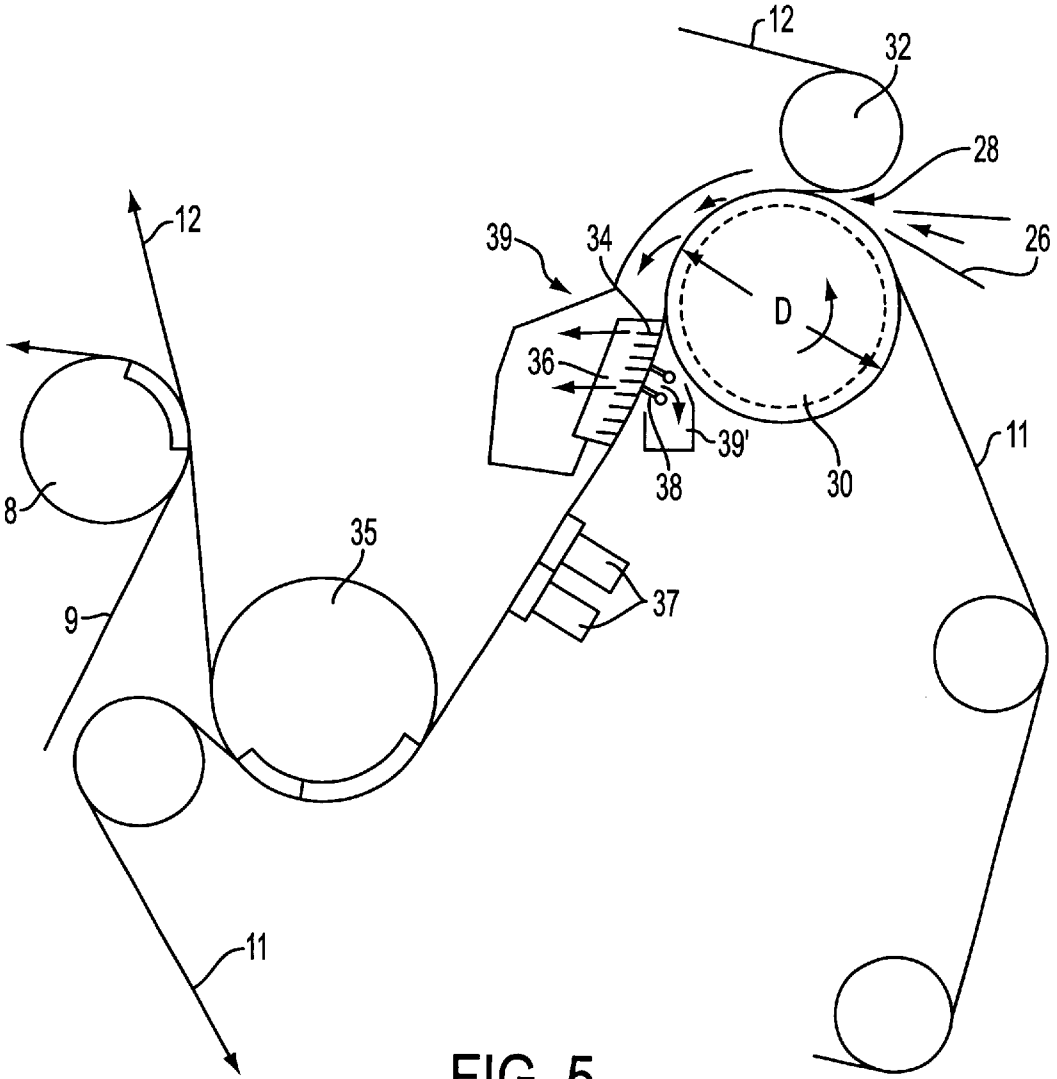
FIG. 5 schematically shows a side schematic view of a twin wire former according to a fifth embodiment of the present invention.

According to the embodiment of FIG. 5, a wire suction roller 35 is provided at the end of the section of the twin wire zone that travels steeply downwardly, inside the perimeter of the top wire 12. Both wires 11, 12 travel together by way of this wire suction roller, with the paper web disposed between the two wires. The wire suction roller 35 has a separating suction zone which separates the paper web and the top wire 12 from the bottom wire 11. The paper web may then be removed from the top wire 12 by way of a felt band 9 and a removal roller 8, or by other devices known by those skilled in the art.

In all embodiments, the forming roller 30 has a relatively large diameter D. For example this diameter D is between about 1.5 and 2.5 meters. Sealing elements can be provided for laterally sealing the inlet gap 28, as disclosed in German Patent Application No. DE 19720258.

According to the embodiments of FIGS. 1, 2, 3 and 6, the deflection roller 42 which the two wire belts 11, 12 wind around together, ensures that there are no significant speed differentials between the two wires. Thus, the present invention employs "S"-shaped web routing. The web is still fluid in the center until the regions of the forming shoe 36 or the balanced-pressure drainage elements 16, 17 are reached. Therefore, no forces or very slight forces are transmitted between the wires in this region. Small speed differentials in this area are thus permitted. The "S"-shaped web routing prevents wear at the wire edges and further prevents negative influences on the strength of the finished paper web.

The present invention may also be modified by replacing at least one of the flexible bottom forming strips 38 (for example, as seen in FIG. 1) that can be flexibly pressed against the bottom wire 11, with a forming water nozzle as disclosed in German Patent Application No. 198 03 451.2. Similarly at least one of the top forming strips 27 (for example, as seen in FIG. 2) that can be flexibly pressed against the top wire 12 can be replaced by a forming water nozzle, also as disclosed in German Patent Application No. 198 03 451.2.

Figure 6:
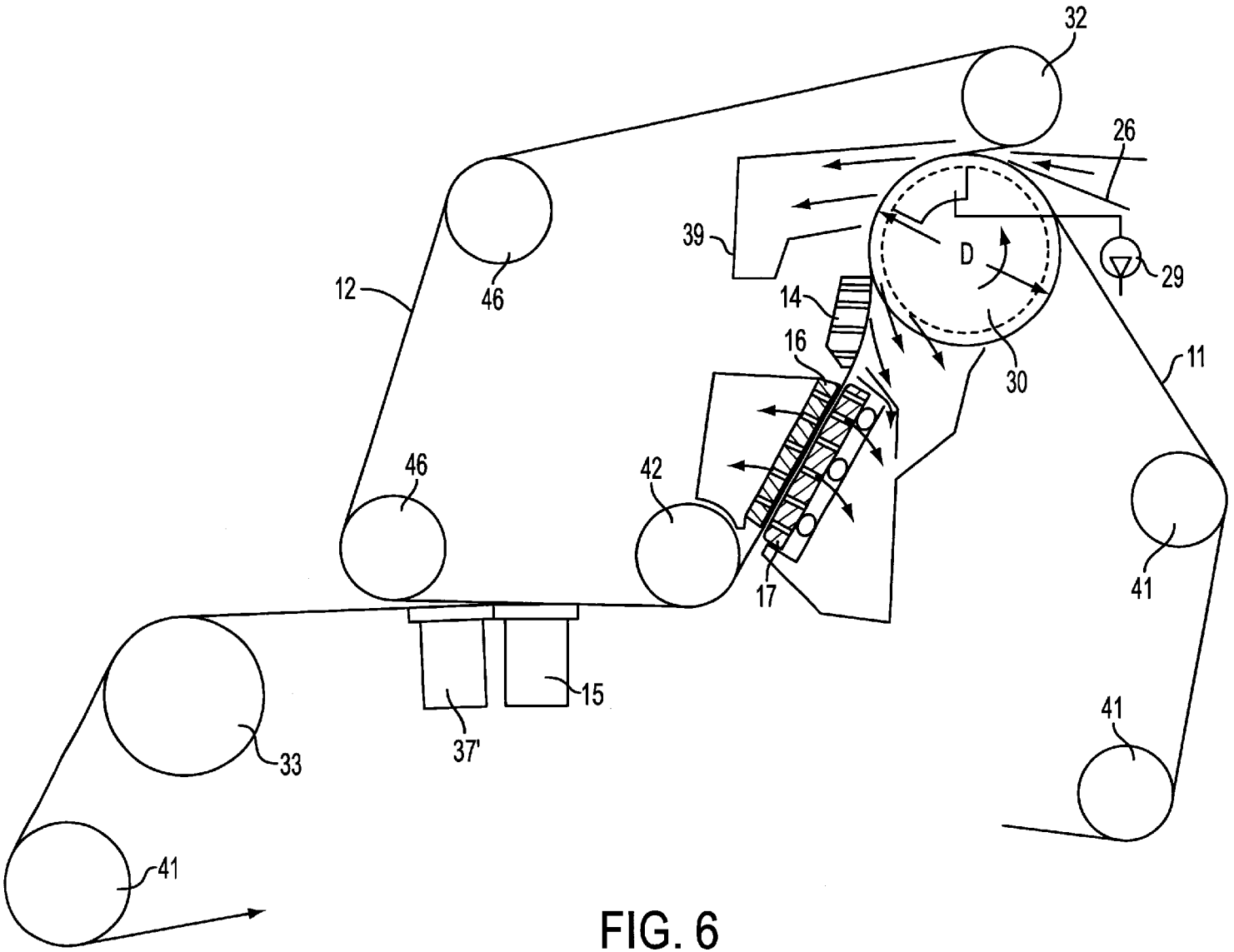
FIG. 6 schematically shows a side schematic view of a twin wire former according to a sixth embodiment of the present invention.

According to the embodiment shown in FIG. 6, the entire web formation takes place without forming strips, i.e., without the introduction of pressure pulsations into the fibrous suspension. Only balanced-pressure drainage elements 16, 17 are present. Specifically, web formation occurs by using the forming roller 30, the guide plate 14, and the balanced-pressure drainage elements 16 and 17, as described in conjunction with the embodiment of FIG. 3. Consequently, a higher percentage of the fines and fillers remains in the paper web produced.

In a preferred embodiment, the forming roller 30 is a suction roller, but it is readily appreciable by those skilled in the art that forming rollers according to alternative embodiments may not employ a suction roller.

The embodiments shown above, particularly the embodiment according to FIG. 6, can be modifies by placing a separating suction device at the end section of the twin wire zone that travels steeply downwardly, inside the perimeter of the top wire 12, in order to separate the bottom wire 11 from the web. The web travels with the top wire by way of the deflection roller 42, which presses the web together with another previously-formed web. In such a case, the twin wire former according to the invention is consequently used to form a layer of a multi-layer paper or cardboard web.

It is noted that the foregoing examples have been provided merely for the purpose of explanation and are in no way to be construed as limiting of the present invention. While the present invention has been described with reference to certain embodiments, it is understood that the words which have been used herein are words of description and illustration rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particular disclosed herein; rather, the present invention extends to all functionally equivalent structure, methods and uses, such as are within the scope of the appended claims.

What is claimed is:

1. A twin wire former for manufacturing a fibrous material web from a fibrous suspension, the twin wire former comprising:

a movable top wire belt arranged to move in a travel direction from a top roll to a bottom roll, wherein the top roll is arranged adjacent a headbox and the bottom roll comprises one of a deflection roll and a suction roll;

a first imaginary straight path being defined between the top roll and the bottom roll;

a rotating forming roller arranged adjacent the headbox;

a second imaginary straight path being defined between the forming roller and the bottom roll;

a movable bottom wire belt arranged to move in the travel direction with the movable top wire belt from the rotating forming roller to the bottom roll;

the movable top wire belt and the movable bottom wire belt converging at a twin wire zone, the twin wire zone having a first section adjacent the headbox, a second section disposed after the first section in the travel direction and an end section which follows the second section in the travel direction;

the movable top wire and the movable bottom wire forming a wedge-shaped inlet gap at said first section of said twin wire zone, wherein the inlet gap is adapted to receive the fibrous suspension from the headbox;

the second section being arranged in a steep downward direction downstream of the forming roller in the travel direction;

the forming roller deflecting the movable top wire belt and the movable bottom wire belt from the first imaginary straight path and away from the headbox;

at least one drainage element arranged in the second section, the at least one drainage element comprising one of first and second opposite facing balanced-pressure drainage elements and a deflection device which deflects the movable top wire and the movable bottom wire from the second imaginary straight path and towards the headbox, wherein the bottom wire belt and the top belt are adapted to form the fibrous web therebetween at the second section of the twin wire zone.

2. The twin wire former of claim 1, wherein the steep downward direction is an angle between about 10 and 50 degrees from a vertical.

3. The twin wire former of claim 2, wherein the steep downward direction is an angle between about 10 and 45 degrees from the vertical.

4. The twin wire former of claim 1, wherein the bottom roll comprises a deflection device adapted to deflect said bottom wire belt and the top wire belt from the steep downward direction to a generally horizontal direction.

5. The twin wire former of claim 1, wherein the top roll comprises a breast roller disposed upstream from the forming roller, the breast roller being adapted to guide the top movable wire belt.

6. The twin wire former of claim 5, wherein the breast roller and the headbox together are adapted to pivot about a rotational axis of the forming roller.

7. The twin wire former of claim 1, wherein the at least one drainage element comprises the deflection device which deflects the movable top wire and the movable bottom wire from the second imaginary straight path and towards the headbox.

8. The twin wire former of claim 7, wherein the deflection device comprises a convexly curved forming shoe disposed against the top wire belt.

9. The twin wire former of claim 8, further comprising at least one deflector disposed against the bottom wire and opposite the convexly curved forming shoe.

10. The twin wire former of claim 8, further comprising at least one forming strip flexibly disposed against said bottom wire and opposite the convexly curved forming shoe.

11. The twin wire former of claim 1, wherein the forming roller has a circumference and wherein the twin wire former further comprises at least one forming strip flexibly disposed against the movable top wire belt adjacent the circumference of the forming roller.

12. The twin wire former of claim 11, wherein the at least one drainage element comprises the first and second opposite facing balanced-pressure drainage elements.

13. The twin wire former of claim 12, wherein the movable top wire belt and the movable bottom wire belt travel along the second imaginary straight path.

14. The twin wire former of claim 1, wherein the at least one drainage element comprises the first and a second balanced-pressure drainage elements, the first balanced-pressure drainage element being stationary and disposed against the movable top wire belt and the second balanced-pressure drainage element being flexibly disposed opposite the first balanced-pressure drainage element against the movable bottom wire belt.

15. The twin wire former of claim 14, further comprising a convexly curve guide plate disposed between the forming roller and the at least one drainage element in the travel direction, wherein the convexly curved guide plate deflects the movable top wire belt and the movable bottom wire belt from the second imaginary straight path and towards the headbox.

16. The twin wire former of claim 15, wherein the convexly curved guide plate is perforated.

17. The twin wire former of claim 14, wherein the first and second balanced-pressure drainage elements each comprise plates.

18. The twin wire former of claim 14, wherein the first and second balanced-pressure drainage elements each comprise plate segments.

19. The twin wire former of claim 14, wherein each of the first and second balanced-pressure drainage elements are fluid-permeable.

20. The twin wire former of claim 14, wherein each of the first and said second balanced-pressure drainage elements are perforated.

21. The twin wire former of claim 1, wherein the forming roller comprises a suction roller.

22. The twin wire former of claim 1, wherein the at least one drainage device comprises a convexly curved forming shoe deflecting the movable top wire belt and the movable bottom wire belt from the second imaginary straight path and wherein the bottom roll comprises a separating device which separates the movable top wire belt from the movable bottom wire belt.

23. The twin wire former of claim 22, wherein the separating device comprises a stationary separating suction device, the stationary suction device being disposed against the movable bottom wire belt in the second section of the twin wire zone.

24. The twin wire former of claim 23, wherein the movable bottom wire belt is adapted to travel in a steep downward direction at a section downstream of the separating device in the travel direction, and wherein the twin wire former further comprises:

at least one additional suction device disposed downstream the separating device; and a removal device adapted to remove the fibrous web material from the movable bottom wire belt at a point downstream from the at least one additional suction device.

25. The twin wire former of claim 1, wherein the movable top wire belt and the movable bottom wire belt are adapted to be conveyed by a wire suction roller at a downstream end of the second section.

26. The twin wire former of claim 25, wherein the wire suction roller is disposed against an inside perimeter of the movable top wire belt, the wire suction roller having a separating suction zone adapted for separating the fibrous material web and the movable top wire belt from the movable bottom wire belt.

27. The twin wire former of claim 1, wherein the twin wire former is free of forming strips.

28. The twin wire former of claim 1, wherein most suspension water is removed from the fibrous material web in the twin zone via gravitational force.

29. The twin wire former of claim 1, wherein the movable top and bottom wire belts with the fibrous material web disposed therebetween are deflected from the second imaginary straight path in a configuration which resembles an S-shaped routing.

30. A twin wire former for manufacturing a fibrous material web from a fibrous suspension, the twin wire former comprising:

a movable top wire belt arranged to move in a travel direction from a breast roll to a deflection roll, wherein the breast roll is arranged adjacent a headbox;

a first imaginary straight path being defined between the breast roll and the deflection roll;

a rotating forming roller arranged adjacent the headbox;

a secondary imaginary straight path being defined between the forming roller and the deflection roll;

a movable bottom wire belt arranged to move in the travel direction with the movable top wire belt from the rotating forming roller to the deflection roll;

the movable top wire belt and the movable bottom wire belt converging at a twin wire zone, the twin wire zone having a first section adjacent the headbox, a second section disposed after the first section in the travel direction and an end section which follows the second section in the travel direction;

the movable top wire and the movable bottom wire forming a wedge-shaped inlet gap at said first section of the twin wire zone, wherein the inlet gap is adapted to receive the fibrous suspension from the headbox;

the second section being arranged in a steep downward direction downstream of the forming roller in the travel direction;

the end section being arranged in a generally horizontal downward direction downstream of the second section in the travel direction;

the forming roller deflecting the movable top wire belt and the movable bottom wire belt from the first imaginary straight path and away from the headbox;

at least one drainage element arranged in the second section, the at least one drainage element comprising a convexly curved forming shoe which deflects the movable top wire and the movable bottom wire from the second imaginary straight path and towards the headbox so as to form an S-shaped routing;

at lest one suction device disposed between the convexly curved forming shoe and the deflection roll;

a separating suction device disposed downstream the deflection roll in the end section; and an additional suction device disposed downstream the separating suction device, wherein the bottom wire belt and the top wire belt are adapted to form the fibrous web therebetween at the second section of the twin wire zone.

31. The twin wire former of claim 30, wherein the forming roller comprises a suction roller.

32. The twin wire former of claim 30, further comprising at least one forming strip disposed against the movable bottom wire and opposite the forming shoe and wherein the separating suction device is adapted to separate the movable bottom wire belt from the movable top wire belt.

33. The twin wire former of claim 30, further comprising a removal device adapted to remove the fibrous web material from the movable bottom wire at a point downstream from the at least one additional suction device.

34. The twin wire former of claim 30, wherein the deflection roll is adapted to deflect the movable bottom wire belt and the movable top wire belt from the second section to the generally horizontal end section.

35. The twin wire former of claim 30, wherein the breast roller is adapted to guide the movable top wire belt and wherein the breast roller and the headbox are together adapted to pivot about a rotational axis of the forming roller.

36. The twin wire former of claim 35, further comprising at least one deflector disposed against the movable bottom wire belt opposite the forming shoe.

37. The twin wire former of claim 36, further comprising at least one forming strip flexibly disposed against the movable top wire belt at a circumference of the forming roller.

38. The twin wire former of claim 30, further comprising at least one deflector disposed against the movable bottom wire belt opposite the forming shoe.

39. The twin wire former of claim 38, further comprising at least one forming strip flexibly disposed against the movable top wire belt at a circumference of the forming roller.

40. The twin wire former of claim 30, wherein the convexly curved guide plate is perforated.

41. A twin wire former for manufacturing a fibrous material web from a fibrous suspension, the twin wire former comprising:

a movable top wire belt arranged to move in a travel direction from a breast roll to a deflection roll, wherein the breast roll is arranged adjacent a headbox;

a first imaginary straight path being defined between the breast roll and the deflection roll;

a rotating forming roller arranged adjacent the headbox;

a second imaginary straight path being defined between the forming roller and the deflection roll;

a movable bottom wire belt arranged to move in the travel direction with the movable top wire belt from the rotating forming roller to the deflection roll;

the movable top wire belt and the movable bottom wire belt converging at a twin wire zone, the twin wire zone having a first section adjacent the headbox, a second section disposed after the first section in the travel direction and an end section which follows the second section in the travel direction;

the movable top wire and the movable bottom wire forming a wedge-shaped inlet gap at said first section of the twin wire zone, wherein the inlet gap is adapted to receive the fibrous suspension from the headbox;

the second section being arranged in a steep downward direction downstream of the forming roller in the travel direction;

the end section being arranged in a generally horizontal direction downstream of the second section in the travel direction;

the forming roller deflecting the movable top wire belt and the movable bottom wire belt from the first imaginary straight path and away from the headbox;

at least one drainage element arranged in the second section, the at least one drainage element comprising first and second opposite facing balanced-pressure drainage elements;

at least one forming strip flexibly disposed against the movable top wire belt and adjacent a circumference of the forming roller;

at least one suction device disposed between the first and second opposite facing balanced-pressure drainage elements and the deflection roll; and at least one separating suction device disposed downstream the deflection roll in the end section, wherein the bottom wire belt and the top wire belt are adapted to form the fibrous web therebetween at the second section of the twin wire zone.

42. The twin wire former of claim 41, further comprising an additional separating suction device disposed downstream of the at least one separating suction device.

43. A twin wire former for manufacturing a fibrous material web from a fibrous suspension, the twin wire former comprising:

a movable top wire belt arranged to move in a travel direction from a breast roll to a deflection roll, wherein the breast roll is arranged adjacent a headbox;

a first imaginary straight path being defined between the breast roll and the deflection roll;

a rotating forming roller arranged adjacent the headbox;

a second imaginary straight path being defined between the forming roller and the deflection roll;

a movable bottom wire belt arranged to move in the travel direction from the rotating forming roller towards the deflection roll;

the movable top wire belt and the movable bottom wire belt converging at a twin wire zone, the twin wire zone having a first section adjacent the headbox, a second section disposed after the first section in travel direction and an end section which follows the second section in the travel direction;

the movable top wire and the movable bottom wire forming a wedge-shaped inlet gap at said first section of the twin wire zone, wherein the inlet gap is adapted to receive the fibrous suspension from the headbox;

the second section being arranged in a steep downward direction downstream of the forming roller in the travel direction;

the forming roller deflecting the movable top wire belt and the movable bottom wire belt from the first imaginary straight path and away from the headbox;

at least one drainage element arranged in the second section, the at least one drainage element comprising a convexly curved forming shoe which deflects the movable top wire and the movable bottom wire from the second imaginary straight path and towards the headbox so as to form an S-shaped routing;

at least one forming strip flexibly disposed against the movable bottom wire belt and opposite the forming shoe;

at least one suction device disposed between the forming shoe and the deflection roll;

at least one separating suction device disposed downstream of the at least suction device; and at least one removal roll disposed downstream of the at least one separating suction device, wherein the bottom wire belt and the top wire belt are adapted to form the fibrous web therebetween at the second section of the twin wire zone.

44. A twin wire former for manufacturing a fibrous material web from a fibrous suspension, the twin wire former comprising:

a movable top wire belt arranged to move in a travel direction from a breast roll to a suction roll, wherein the breast roll is arranged adjacent a headbox;

a first imaginary straight path being defined between the breast roll and the suction roll;

a rotating forming roller arranged adjacent the headbox;

a second imaginary straight path being defined between the forming roller and the suction roll;

a movable bottom wire belt arranged to move in the travel direction with the movable top wire belt from the rotating forming roller to the suction roll;

the movable top wire belt and the movable bottom wire belt converging at a twin wire zone, the twin wire zone having a first section adjacent the headbox, a second section disposed after the first section in the travel direction and an end section which follows the second section in the travel direction;

the movable top wire and the movable bottom wire forming a wedge-shaped inlet gap at said first section of the twin wire zone, wherein the inlet gap is adapted to receive the fibrous suspension from the headbox;

the second section being arranged in a steep downward direction downstream of the forming roller in the travel direction;

the forming roller deflecting the movable top wire belt and the movable bottom wire belt from the first imaginary straight path and away from the headbox;

at least one drainage element arranged in the second section, the at least one drainage element comprising a convexly curved forming shoe which deflects the movable top wire and the movable bottom wire from the second imaginary straight path and towards the headbox so as to form an S-shaped routing;

at least one forming strip flexibly disposed against the movable bottom wire belt and opposite the forming shoe; and at least one suction device disposed between the forming shoe and the suction roll, wherein the bottom wire belt and the top wire belt are adapted to form the fibrous web therebetween at the second section of the twin wire zone.

45. The twin wire former of claim 44, wherein the suction roll comprises a wire suction roller which is adapted to separate the movable top wire belt from the movable bottom wire belt.

46. The twin wire former for manufacturing a fibrous material web from a fibrous suspension, the twin wire former comprising:

a movable top wire belt arranged to move in a travel direction from a top roll to a bottom roll, wherein the top roll is arranged adjacent a headbox and the bottom roll comprises a deflection roll;

a first imaginary straight path being defined between the top roll and the bottom roll;

a rotating forming roller arranged adjacent the headbox;

a second imaginary straight path being defined between the forming roller and the bottom roll;

a movable bottom wire belt arranged to move in the travel direction with the movable top wire belt from the rotating forming roller to the bottom roll;

the movable top wire belt and the movable bottom wire belt converging at a twin wire zone, the twin wire zone having a first section adjacent the headbox, a second section disposed after the first section in the travel direction and an end section which follows the second section in the travel direction;

the movable top wire and the movable bottom wire forming a wedge-shaped inlet gap at said first section of said twin wire zone, wherein the inlet gap is adapted to receive the fibrous suspension from the headbox;

the second section being arranged in a steep downward direction downstream of the forming roller in the travel direction;

the forming roller deflecting the movable top wire belt and the movable bottom wire belt from the first imaginary straight path and away from the headbox;

a convexly curved guide plate arranged in the second section, the convexly curved guide plate deflecting the movable top wire and the movable bottom wire from the second imaginary straight path and towards the headbox; and at least one drainage element disposed in the second section and comprising first and second opposite facing balanced-pressure drainage elements, wherein the bottom wire belt and the top wire belt are adapted to form the fibrous web therebetween at the second section of the twin wire zone.

47. The twin wire former of claim 46, wherein the deflection roll is adapted to deflect the movable bottom wire belt and the movable top wire belt from the second section to the generally horizontal end section.

48. The twin wire former of claim 46, wherein the forming roller comprises a suction roller.

49. The twin wire former of claim 46, further comprising at least one separating suction device disposed against the movable bottom wire belt in the end section.

50. The twin wire former of claim 49, further comprising a water collection device disposed adjacent the movable top wire belt in the area of the forming roller.

51. A method of manufacturing a fibrous material web from a fibrous suspension using a twin wire former which comprises a movable top wire belt arranged to move in a travel direction from a top roll to a bottom roll, wherein the top roll is arranged adjacent a headbox and the bottom roll comprises one of a deflection roll and a suction roll, a first imaginary straight path being defined between the top roll and the bottom roll, a rotating forming roller arranged adjacent the headbox, a second imaginary straight path being defined between the forming roller and the bottom roll, a movable bottom wire belt arranged to move in the travel direction with the movable top wire belt from the rotating forming roller to the bottom roll, the movable top wire belt and the movable bottom wire belt converging at a twin wire zone, the twin wire zone having a first section adjacent the headbox, a second section disposed after the first section in the travel direction and an end section which follows the second section in the travel direction, the movable top wire and the movable bottom wire forming a wedge-shaped inlet gap at said first section of said twin wire zone, wherein the inlet gap is adapted to receive the fibrous suspension from the headbox, the second section being arranged in a steep downward direction downstream of the forming roller in the travel direction, the forming roller deflecting the movable top wire belt and the movable bottom wire belt from the first imaginary straight path and away from the headbox, at least one drainage element arranged in the second section, the at least one drainage element comprising one of first and second opposite facing balanced-pressure drainage elements and a deflection device which deflects the movable top wire and the movable bottom wire from the second imaginary straight path and towards the headbox, the method comprising:

depositing a fibrous suspension into the inlet gap from the headbox;

draining fluid from the fibrous suspension through the rotating forming roller;

forming a fibrous web between the movable top and bottom wire belts;

draining fluid from the fibrous web in the second section; and separating the movable top wire belt and the movable bottom wire belt.

52. The method of claim 51, further comprising deflecting the movable top and bottom wire belts to a generally horizontal direction with bottom roll.

53. The method of claim 51, further comprising:

guiding the movable top wire about the top roll, wherein the top roll comprises a breast roller; and pivoting the breast roller together with the headbox about a rotational axis of the forming roller.

54. The method of claim 51, further comprising forming the fibrous web between the movable top and bottom wire belts in the second section, wherein the at least one drainage element comprises a deflection device which deflects the movable top wire and the movable bottom wire from the second imaginary straight path and towards the headbox with a convexly curved forming shoe.

55. The method of claim 51, further comprising forming the fibrous web between the movable top and bottom wire belts in the second section, wherein the at least one drainage element comprises first and second balanced-pressure elements.

* * * * *